United States Patent [19]

Riggs, Jr.

[11] Patent Number: 4,874,434

[45] Date of Patent: Oct. 17, 1989

[54] METHOD OF TREATING A TITANIUM STRUCTURE

[75] Inventor: Olen L. Riggs, Jr., Oklahoma City, Okla.

[73] Assignee: Kerr-McGee Chemical Corporation, Oklahoma City, Okla.

[21] Appl. No.: 194,644

[22] Filed: May 16, 1988

[51] Int. Cl.[4] ..... C23G 1/10; B08B 3/08

[52] U.S. Cl. ..... 134/3; 134/28; 134/41

[58] Field of Search ..... 134/3, 78, 41

[56] References Cited

U.S. PATENT DOCUMENTS

| | | | |
|---|---|---|---|
| 2,827,402 | 3/1958 | Achers et al. | 134/28 |
| 2,829,091 | 4/1958 | Missel | 134/28 |
| 3,725,224 | 4/1973 | Kendall | 134/2 |
| 4,606,804 | 8/1986 | Schulke et al. | 204/286 |

FOREIGN PATENT DOCUMENTS

| | | | |
|---|---|---|---|
| 0158335 | 12/1979 | Japan | 134/28 |

OTHER PUBLICATIONS

Kirk-Othmer *Encyclopedia of Chemical Technology*, 2ed, vol. 20, pp. 358, 359.

*Primary Examiner*—Asok Pal

*Attorney, Agent, or Firm*—William G. Addison; John P. Ward

[57] ABSTRACT

The present invention relates to a method for chemically treating structures fabricated from titanium based alloy compositions which compositions inherently possess positive open circuit corrosion potentials and reduced rates of corrosion properties. The method comprises contacting said fabricated structures with an aqueous pickling solution of hydrofluoric and sulfuric acids at a temperature of at least ambient temperature. This contact is continued for a time sufficient to remove any deleterious oxide layers adhered to the surfaces of the alloy compositions of the fabricated structures.

4 Claims, No Drawings

METHOD OF TREATING A TITANIUM STRUCTURE

FIELD OF THE INVENTION

The present invention relates to a method of treating structures fabricated from certain titanium base alloy compositions. Particularly, the present invention relates to a method for chemically treating structures fabricated from certain titanium base alloy compositions and which alloy compositions inherently possess both positive open circuit potentials and substantially reduced tendencies to corrode in mineral acid environments.

BACKGROUND OF THE INVENTION

Methods for surface treating or conditioning products fabricated from titanium and titanium alloys are well-known. Broadly, such known methods have included both mechanical and chemical treating or conditioning means. For example, both heavy grinding and lathe turning have been and are used for conditioning the surfaces of heavy products of titanium such as billets and slabs. For the surface conditioning of lighter products of titanium such as sheet, strip, bar and wire products and the like, both mechanical and chemical conditioning means are employed including grit blasting, grinding, caustic descaling and acid pickling.

By far, the most commonly employed means for treating or conditioning the surfaces of products fabricated from titanium is that of acid pickling. The pickling solutions most often employed are mixed solutions of nitric and hydrofluoric acids. Generally, the concentrations of the acid components in such solutions will range from about 15 to 30 weight percent for the nitric acid component and from about 2 to about 4 weight percent for the hydrofluoric acid component in such solutions. According to Kirk-Othmer, *Encyclopedia of Chemical Technology*, 2ed, Vol 20, page 359 (1969) the higher nitric acid concentrations are employed to minimize hydrogen absorption while the hydrofluoric acid concentration will determine the pickling rate.

Although the above described acid pickling solutions work well for their intended use, i.e., the removal of surface oxide scales formed during the working and annealing processes used in the manufacture of fabricated products of most commercial grades of titanium, their use in the treatment or conditioning of products fabricated from certain titanium base alloy compositions has been found to be detrimental. For example, the use of a pickling solution comprised of nitric and hydrofluoric acids to treat or condition the surfaces of structures fabricated from titanium based alloys containing iron and copper as alloying constituents tends to degrade certain of the desirable inherent properties of these alloys. Particularly, it has been found that when structures fabricated from titanium alloys containing both iron and copper are treated or conditioned with a nitric acid/hydrofluoric acid pickling solution the critical properties of positive open circuit potential and a substantially reduced rate of corrosion inherent in these alloys is significantly degraded, if not lost completely.

SUMMARY OF THE INVENTION

The present invention relates to a novel method for treating structures fabricated from certain titanium based alloy compositions and which alloy compositions possess the inherent properties of positive open circuit corrosion potentials and substantially reduced rates of corrosion when exposed to mineral acid environments. Particularly, the present invention is directed to a method for chemically treating such fabricated structures whereby the inherent properties of the titanium based alloy compositions from which the structures are fabricated substantially are retained.

In accordance with the method of the present invention, a structure fabricated from a titanium based alloy composition containing iron and copper as alloying constituents is contacted with an aqueous pickling solution comprising a mixture of hydrofluoric and sulfuric acids. While contacting the fabricated structure with this aqueous pickling solution, the aqueous solution is maintained at a temperature of at least about ambient temperature. This contact is maintained at said temperature for a period sufficient to permit removal of any deleterious oxide layers adhered to the surface of the alloy composition of the fabricated structure. It has been found that structures fabricated from titanium based alloy compositions containing iron and copper as alloying constituents and treated in accordance with the method of this invention substantially will retain the above disclosed properties inherent in these alloy compositions.

DETAILED DESCRIPTION OF THE INVENTION

As disclosed herein, the method of the present invention is particularly suited to the treatment of structures fabricated from titanium based alloy compositions containing both iron and copper as alloying constituents. Broadly, the novel method of this invention is applicable to the treatment of structures fabricated from the titanium based alloy compositions described in copending U.S. patent application No. 931,993 filed Nov. 18, 1986, now U.S. Pat. No. 4,744,878 and assigned to the same assignee as this application.

In the above identified copending application, the teachings of which are incorporated herein by reference in their entirety, are disclosed titanium based alloy compositions containing certain prescribed amounts of iron and copper. Specifically, the titanium based alloy compositions described in this copending application and from which structures can be fabricated which are amenable to treatment in accordance with the method of this invention, are those titanium based alloy compositions containing from about 0.25 to about 1.5 weight percent of iron and from about 0.1 to about 1.5 weight percent of copper. The percentages of iron and copper are based on the weight of the alloy composition as a whole, with the balance of the alloy composition being substantially all titanium, apart from the incidental impurities. In addition to the iron and copper alloying constituents, said titanium based alloy compositions further may contain oxygen and aluminum as alloying constituents. When present, the oxygen can range from about 0.15 to about 0.5 weight percent and the aluminum can be present in amounts ranging up to about 0.01 weight percent based on the total weight of the alloy composition. These titanium based alloys are particularly characterized by their inherent properties of positive open circuit corrosion potentials and substantially reduced rates of corrosion.

The structures fabricated from the above described alloy compositions and amenable to treatment in accordance with this invention can be in any form such as, for example, bar, plate, flat sheet, wire, and the like. However, particularly useful structures which can be fabricated from the above described alloy compositions are anode structures and particularly those anode structures intended for use in electrolytic cells for the manufacture of battery grade manganese dioxide. One such anode structure into which these alloy compositions can be fabricated is the anode structure described in U.S. Pat. No. 4,606,804 issued Aug. 19, 1986.

As disclosed herein, the aqueous pickling solutions useful in the practice of the present invention comprise both hydrofluoric acid and sulfuric acid. With regard to the hydrofluoric acid component, the concentration of this acid in the aqueous pickling solution will be a concentration of at least about 5 grams per liter (g/l) of the solution. Generally, it is desirable that the concentration of the hydrofluoric acid be maintained within a range of from about 5 g/l to about 200 g/l of the solution. In the practice of the invention defined herein, particularly good results can be achieved by the use of aqueous pickling solutions containing hydrofluoric acid concentrations ranging from about 20 g/l to about 50 g/l of the solution.

With regard to the sulfuric acid component of the aqueous pickling solutions useful in the practice of this invention, this acid component will be present in a concentration of at least about 25 g/l of the treating solution. Broadly, the concentration of this particularly acid component will be maintained within the range of from about 25 g/l to about 500 g/l of the solution. Again, particularly good results can be achieved when the sulfuric acid concentration of the aqueous pickling solutions employed in the practice of the present invention is maintained within the range of from about 25 g/l to about 250 g/l of the solution.

In treating fabricated structures formed from the titanium based alloy compositions as described herein and in U.S. patent application No. 931,993 (now U.S. Pat. No. 4,744,878), the contact between the structures and the aqueous pickling solution will be maintained for a period ranging from a few seconds up to several hours. While the length of this period of contact is dependent upon a number of factors such as, for example, solution concentration, the extent of the oxide layer desired to be removed and the like, the factor having the greatest impact is that of temperature. For example, it has been found that when contact between the fabricated structure desired to be treated and the aqueous pickling solution is carried out at ambient temperatures, up to 24 hours are required to effect the desired treatment. When substantially elevated temperatures are employed such as those disclosed hereinbelow, then the period of contact can be as short as about 30 seconds. In a preferred embodiment of this invention, utilizing the preferred range of temperatures set forth below, the period of contact between the fabricated structure and the aqueous pickling solution will range from about 0.5 to about 5.0 minutes.

As discussed herein, the temperatures at which the aqueous pickling solution is maintained during the period of contact between the solution and the fabricated structure undergoing treatment can vary widely. However, the minimum temperature employed will be at least ambient temperature. Generally, the temperatures used in the practice of this invention will range from about ambient temperature to about 150° C. The preferred temperatures, i.e., the temperatures which will provide for treatment of the fabricated structure within the preferred period of contact disclosed above, are those temperatures within the range of from about 100° C. to about 150° C.

After the fabricated structure has been treated in accordance with the present method to remove any deleterious oxide layer deposited on the surfaces thereof, it is removed from contact with the aqueous pickling solution, thoroughly rinsed with deionized water, and dried.

As disclosed herein, the method constituting the present invention is particularly suited to the surface treating or conditioning of structures fabricated from titanium based alloy compositions containing both iron and copper as alloying constituents. The particular suitability of the present method is based on the observation that conventional pickling solutions, e.g., mixed hydrofluoric acid/nitric acid pickling solutions, degrade the desired inherent properties of titanium based alloy compositions containing iron and copper whereas the aqueous pickling solutions utilized in the present method do not.

The following examples are set forth for purposes of illustration only. These examples are not to be construed as limiting the scope and application of this invention.

EXAMPLE 1

A pickling solution is prepared by slowly adding 250 grams of sulfuric acid to a one liter volumetric flask containing 450 milliliters of deionized water. Following addition of the sulfuric acid, 20 grams of hydrofluoric acid then are added to the flask. Sufficient additional deionized water then is added to provide a total of one liter of solution.

A portion of the above pickling solution is poured into a 50 milliliter plastic beaker wherein it is maintained at a temperature of 104° C. A test coupon of a titanium based alloy composition containing 0.6 weight percent iron and 0.5 weight percent copper, based on the total weight of the composition, the balance being substantailly titanium, and measuring 0.5 inch by 1.0 inch is immersed in this pickling solution for one minute. At the end of this time it is removed from the pickling solution, thoroughly rinsed with deionized water and air dried.

Following the above described pickling procedure, the test coupon is subjected to potentiodynamic testing. For this testing, the coupon is employed as an anode in a Princeton Applied Research corrosion test cell in which the electrolyte comprises a manganese sulfate/-sulfuric acid solution. The electrolyte contains about 37.3 g/l of $Mn^{2+}$ ions and about 30.7 g/l of $H_2SO_4$. This electrolyte is maintained at a temperature of about 95° C. The cathode is graphite. The potentiometric scanning rate is 10 millivolts (mv) per second. The test coupon is connected to a potentiostat for measurement of the open circuit corrosion potential of the coupon upon the application of a current thereto. The open circuit corrosion potential or anodic polarization curve then is recorded on a Hewlett-Packard X-Y plotter. The test coupon treated in accordance with the above described procedure and employing the above prepared pickling solution exhibited an open circuit corrosion potential of +210 millivolts versus a standard calomel electrode.

EXAMPLE 2

A second test coupon of the titanium based alloy composition containing 0.6 weight percent iron and 0.5 weight percent copper is treated and tested using the same procedures as described in Example 1. Example 2 differs from Example 1 only in the compositional make-up of the pickling solution employed. In this Example 2, the aqueous pickling solution contained 100 grams of sulfuric acid and 30 grams of hydrofluoric acid per liter of said solution. The test coupon treated with this pickling solution exhibited an open circuit corrosion potential of +180 millivolts versus a standard calomel electrode.

COMPARATIVE EXAMPLE

For purposes of comparison, the procedures of Example 1 again are followed to treat and test an additional coupon of the titanium based alloy composition described above, except that a more conventional mixed solution of nitric and hydrofluoric acids is employed as the aqueous pickling solution. This solution comprised 350 grams of nitric acid and 50 grams of hydrofluoric acid per liter of solution. The pickling treatment is carried out at 38° C., again for a period of one minute.

The test coupon treated with this more conventional aqueous pickling solution exhibited an open circuit potential of −710 millivolts versus a standard calomel electrode.

The above Examples 1 and 2 clearly demonstrate the efficacy of the novel method of this invention. In each instance, the test coupons fabricated from the titanium based alloy composition containing iron and copper and treated in accordance with the present invention, retained the positive open circuit corrosion potential characteristic of said alloy. By contrast, the test coupon prepared from the same identical titanium based alloy composition and treated using the more conventional nitric acid/hydrofluoric acid pickling solution did not retain this characteristic, i.e., the open circuit corrosion potential of this test coupon was negative.

While the present invention has been described with regard to what is believed to be the preferred embodiments thereof, it is to be understood that changes and modifications can be made without departing from the spirit and scope of the invention as defined in the following claims.

I claim:

1. A method for treating a structure fabricated from a titanium base alloy composition consisting essentially of about 0.25 to about 1.5 weight percent of iron and about 0.1 to about 1.5 weight percent of copper, based on the weight of the composition, the balance being substantially all titanium apart from incidental impurities and where said titanium base alloy composition further is characterized by inherent properties of positive open circuit corrosion potentials and substantially reduced rates of corrosion, said method comprising:

providing an aqueous pickling solution comprising at least about 5 g/l of hydrofluoric acid and at least about 25 g/l of sulfuric acid;

contacting said aqueous solution with said fabricated structure; and maintaining said aqueous solution, while in contact with said fabricated structure, at a temperature of at least about ambient temperature and continuing said contact at said temperature for a period ranging up to about 24 hours whereby upon discontinuing said contact, said inherent properties of the titanium base alloy composition from which the structure is fabricated are retained.

2. The method of claim 1 wherein said aqueous pickling solution comprises from about 5 to about 200 g/l of hydrofluoric acid and from about 25 to about 250 g/l of sulfuric acid.

3. The method of claim 1 wherein said aqueous pickling solution is maintained, while in contact with said fabricated structure, at a temperature of from about ambient temperature to about 150° C. and wherein said contact is continued at said temperature for a period of from about 0.5 minutes to about 24 hours.

4. The method of claim 3 wherein said aqueous solution is maintained at a temperature of from about 100° C. to about 125° C. and wherein said contact is continued at said temperature for a period of from about 0.5 to about 5.0 minutes.

* * * * *